US008221088B2

(12) United States Patent
Tian et al.

(10) Patent No.: US 8,221,088 B2
(45) Date of Patent: Jul. 17, 2012

(54) LINEAR COMPRESSOR CONTROLLER

(75) Inventors: Zhuang Tian, Auckland (NZ); John H. Boyd, Jr., Holland, MI (US)

(73) Assignee: Fisher & Paykel Appliance Limited, Auckland (NZ)

( * ) Notice: Subject to any disclaimer, the term of this patent is extended or adjusted under 35 U.S.C. 154(b) by 879 days.

(21) Appl. No.: 11/995,962

(22) PCT Filed: Jul. 25, 2006

(86) PCT No.: PCT/NZ2006/000191

§ 371 (c)(1),
(2), (4) Date: Oct. 13, 2008

(87) PCT Pub. No.: WO2007/013821

PCT Pub. Date: Feb. 1, 2007

(65) Prior Publication Data

US 2009/0081049 A1 Mar. 26, 2009

(30) Foreign Application Priority Data

Jul. 25, 2005 (NZ) ..... 541466

(51) Int. Cl.
*F04B 49/00* (2006.01)

(52) U.S. Cl. ..... 417/12; 417/44.11; 417/44.1

(58) Field of Classification Search ..... 417/12, 417/44.11, 44.1, 45, 415, 417; 318/120, 318/135, 124, 119, 127
See application file for complete search history.

(56) References Cited

U.S. PATENT DOCUMENTS

| | | | |
|---|---|---|---|
| 6,536,326 | B2 | 3/2003 | Unger et al. |
| 6,809,434 | B1 | 10/2004 | Duncan et al. |
| 6,812,597 | B2 | 11/2004 | McGill et al. |
| 6,832,898 | B2 | 12/2004 | Yoshida et al. |
| 6,864,647 | B2 | 3/2005 | Duncan et al. |
| 2004/0169480 | A1 * | 9/2004 | Ueda et al. ..... 318/114 |

FOREIGN PATENT DOCUMENTS

| | | |
|---|---|---|
| WO | 00/16482 | 3/2000 |
| WO | 2004/008626 | 1/2004 |
| WO | 2004/094826 | 11/2004 |

* cited by examiner

*Primary Examiner* — Anne Hines
(74) *Attorney, Agent, or Firm* — Clark Hill PLC

(57) ABSTRACT

A control for a linear compressor energises the linear motor in harmony with the present natural frequency of the compressor. The controller monitors the present operating frequency and compares the frequency with one or more outer limit thresholds. The control may remove power from the linear motor if the running frequency drops below a lower threshold. The control may reduce power to the linear motor if the running frequency rises above an upper threshold. The control uses compressor running frequency to operate the comperssor within safe operating limits.

21 Claims, 7 Drawing Sheets

LINEAR COMPRESSOR CONTROLLER

This application is a National Phase filing of PCT/NZ2006/000191, having an International filing date of Jul. 25, 2006, which disclosure is herein incorporated by reference.

FIELD OF INVENTION

This invention relates to a system of control for a free piston linear compressor and in particular, but not solely, a refrigerator compressor.

PRIOR ART

Linear compressors operate on a free piston basis and require close control of stroke amplitude since, unlike conventional rotary compressors employing a crank shaft, stroke amplitude is not fixed. The application of excess motor power for the conditions of the fluid being compressed may result in the piston colliding with the head gear of the cylinder in which it reciprocates.

When it is desired deliberately to run the compressor at maximum power and high volumetric efficiency it is very important to ensure the collision detection system does not miss the onset of collisions as they will be a regular and expected occurrence in this mode of operation and successive collisions with increasing power will cause damage. A number of patents, including U.S. Pat. No. 6,536,326 and U.S. Pat. No. 6,812,597, describe ways of detecting piston collisions.

U.S. Pat. No. 6,809,434 discloses a control system for a free piston compressor which limits motor power as a function of a property of the refrigerant entering the compressor. However the described system requires additional sensors to sense the refrigerant property.

Some linear compressors described in the prior art operate with static or dynamic gas bearings that only operate effectively when the discharge pressure is above a minimum level. Other linear compressors described in the prior art have oil lubrication systems that may not operate effectively during low power operation.

SUMMARY OF THE INVENTION

It is an object of the present invention to provide a control system for a free-piston linear compressor which avoids operating the compressor in one or more undesirable modes.

In a first aspect the invention consists in a method of controlling a free-piston linear compressor comprising the steps of:

energizing said compressor according to a demand load so that said compressor reciprocates at its natural frequency according to the system operating conditions, monitoring the frequency of reciprocation of said compressor, and ceasing to energise said compressor when the frequency of reciprocation is below a floor threshold.

In a further aspect the invention consists in a method of controlling a free-piston linear compressor comprising the steps of:

energizing said compressor according to a demand load so that said compressor reciprocates at its natural frequency according to the system operating conditions, monitoring the frequency of reciprocation of said compressor, and reducing the power applied to said compressor when the frequency of reciprocation is above a ceiling threshold.

In a further aspect the invention consists in a free piston gas compressor comprising:

a cylinder, a piston, the piston reciprocable within the cylinder, a reciprocating linear electric motor coupled to the piston and having at least one excitation winding, a controller receiving feedback concerning the operation of the compressor, providing a drive signal for applying current to the linear motor in harmony with the instant natural frequency of the compressor, the controller including means for removing power from the compressor when the natural frequency of the compressor falls below a floor threshold.

In a further aspect the invention consists in a free piston gas compressor comprising:

a cylinder, a piston, the piston reciprocable within the cylinder, a reciprocating linear electric motor coupled to the piston and having at least one excitation winding, a controller receiving feedback concerning the operation of the compressor, providing a drive signal for applying current to the linear motor in harmony with the instant natural frequency of the compressor, the controller including means for reducing power to the compressor when the natural frequency of the compressor rises above a ceiling threshold.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings.

DESCRIPTION OF THE PREFERRED EMBODIMENTS

The present invention relates to controlling a free piston reciprocating compressor powered by a linear electric motor. A typical, but not exclusive, application would be in a refrigerator.

A controller provides a drive signal for applying current to the linear motor in harmony with the instant natural frequency of the compressor. The controller monitors the prevailing frequency and reduces power if the frequency is above an upper threshold, or turns off the compressor if the frequency falls below a lower threshold, or both.

Figure 1:
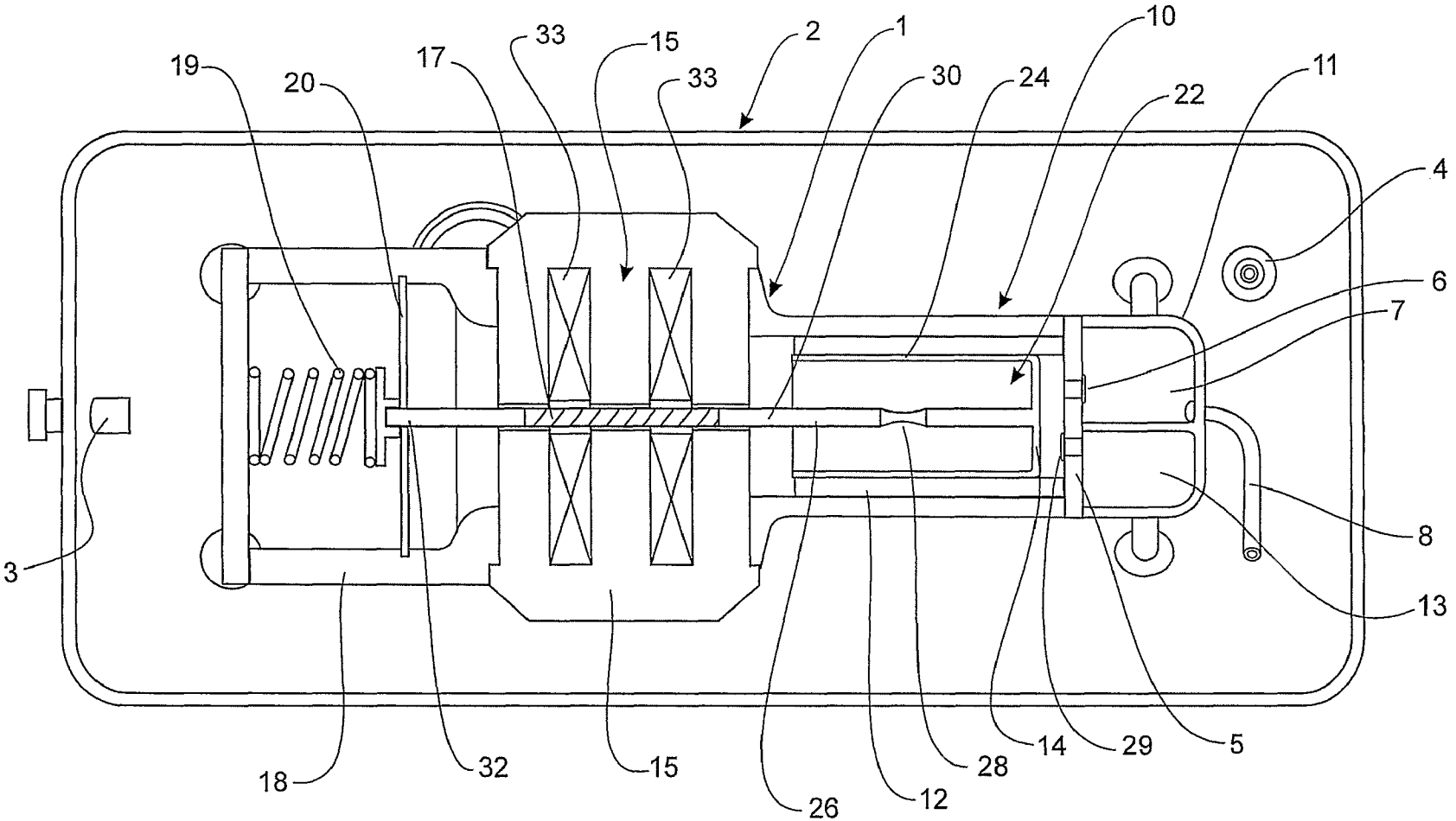
FIG. 1 is a longitudinal axial-section of a linear compressor controlled according to the present invention.

By way of example only, and to provide context, a free piston linear compressor which may be controlled in accordance with the present invention is shown in FIG. 1.

A compressor for a vapour compression refrigeration system includes a linear compressor 1 supported inside a shell 2. Typically the housing 2 is hermetically sealed and includes a gases inlet port 3 and a compressed gases outlet port 4. Uncompressed gases flow within the interior of the housing surrounding the compressor 1. These uncompressed gases are drawn into the compressor during the intake stroke, are compressed between a piston crown 14 and valve plate 5 on the compression stroke and expelled through discharge valve 6 into a compressed gases manifold 7. Compressed gases exit the manifold 7 to the outlet port 4 in the shell through a flexible tube 8. To reduce the stiffness effect of discharge tube 8, the tube is preferably arranged as a loop or spiral transverse to the reciprocating axis of the compressor. Intake to the compression space may be through the head, suction manifold 13 and suction valve 29.

The illustrated linear compressor 1 has, broadly speaking, a cylinder part and a piston part connected by a main spring. The cylinder part includes cylinder housing 10, cylinder head 11, valve plate 5 and a cylinder 12. An end portion 18 of the cylinder part, distal from the head 11, mounts the main spring relative to the cylinder part. The main spring may be formed as a combination of coil spring 19 and flat spring 20 as shown in FIG. 1. The piston part includes a hollow piston 22 with sidewall 24 and crown 14.

The compressor electric motor is integrally formed with the compressor structure. The cylinder part includes motor stator 15. A co-acting linear motor armature 17 connects to the piston through a rod 26 and a supporting body 30. The linear motor armature 17 comprises a body of permanent magnet material (such as ferrite or neodymium) magnetised to provide one or more poles directed transverse to the axis of reciprocation of the piston within the cylinder liner. An end portion 32 of armature support 30, distal from the piston 22, is connected with the main spring.

The linear compressor 1 is mounted within the shell 2 on a plurality of suspension springs to isolate it from the shell. In use the linear compressor cylinder part will oscillate but if the piston part is made very light compared to the cylinder part the oscillation of the cylinder part is small compared with the relative reciprocation between the piston part and cylinder part.

An alternating current in the stator windings, not necessarily sinusoidal, creates an oscillating force on armature magnets 17 to give the armature and stator substantial relative movement provided the oscillation frequency is close to the natural frequency of the mechanical system. The initial natural frequency is determined by the stiffness of the spring 19, and mass of the cylinder 10 and stator 15.

However as well as spring 19, there is an inherent gas spring, the effective spring constant of which, in the case of a refrigeration compressor, varies as either evaporator or condenser pressure (and temperature) varies. A control system which applies stator winding current, and thus driving force, taking this into account has been described in U.S. Pat. No. 6,809,434, the contents of which are incorporated herein by reference. U.S. Pat. No. 6,809,434 also describes a system for limiting maximum motor power to minimise piston cylinder head collisions based on frequency and evaporator temperature.

Preferably but not necessarily the control system of the present invention operates in conjunction with the control system disclosed in U.S. Pat. No. 6,809,434.

Figure 2:
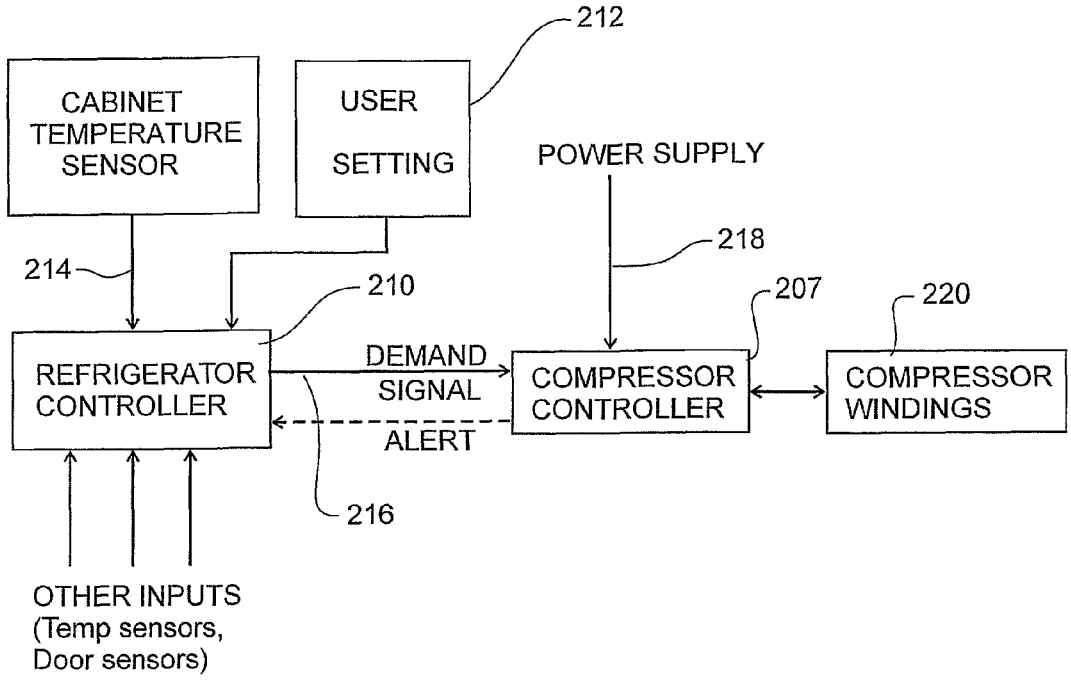
FIG. 2 shows a refrigerator control system in block diagram form.

To provide context for the linear compressor control system in the present invention a basic control system for a refrigerator is shown in FIG. 2.

The control improvements of the present invention reside within the compressor controller 207.

The compressor controller 207 receives a demand signal 216 from refrigerator controller 210. The refrigerator controller 210 receives a user setting input from user interface 212, and receives one or more sensor inputs, including for example a cabinet temperature sensor input on line 214. Other inputs may include inputs from temperature sensors in additional cabinet compartments, inputs from door opening and closing sensors and inputs from evaporator temperature or pressure sensors. From these inputs the refrigerator controller 210 generates a demand signal 216.

The demand signal 216 may simply require the compressor to operate according to one of a select group of modes, which group may be as limited as on or off, or may include an additional maximum setting, or may include a wider range of possible compressor capacity levels. A capacity level broadly indicates the mass of refrigerant that the compressor moves from the suction side of the refrigeration system to the discharge side of the refrigeration system in a given time period. Preferably the demand signal consists of any value across a range, which for the compressor controller may correspond with variation from no operation at one end and be open ended at the other end. The demand signal may be an analogue signal, for example a varying voltage level or varying frequency, or a digital signal, for example an 8-bit output signal.

The compressor controller 207 receives power from a power supply, and receives the demand signal 216. The compressor controller is connected to the windings 220 of the motor of the compressor assembly. The compressor controller commutates power from the power supply 218 to the windings of the compressor according to the demand signal 216 and in accordance with control programs executing in the compressor controller.

Figure 3:
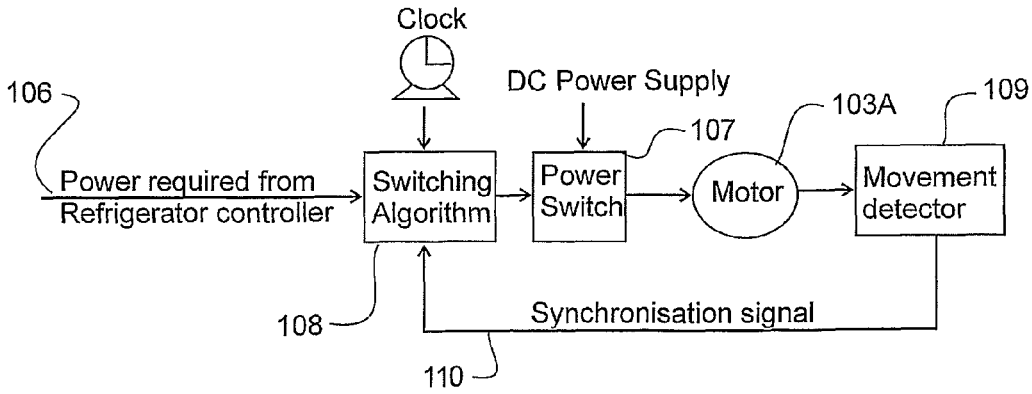
FIG. 3 shows a basic linear compressor control system using electronic commutation with switching timed from compressor motor back EMF.
Figure 4:
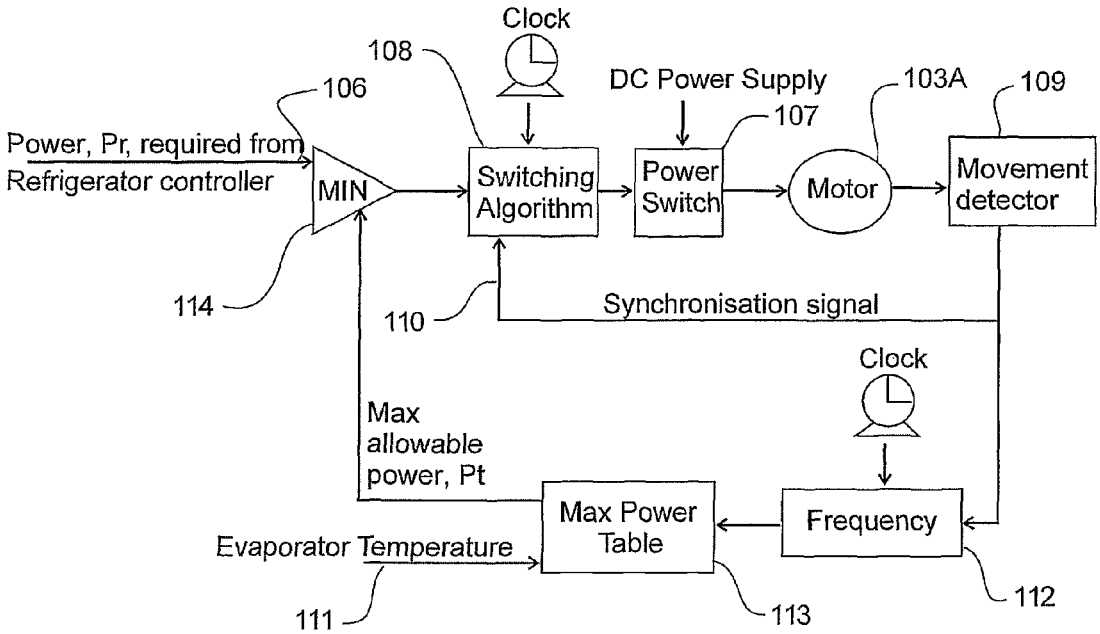
FIG. 4 shows the control system of FIG. 3 with piston collision avoidance measures.
Figure 5:
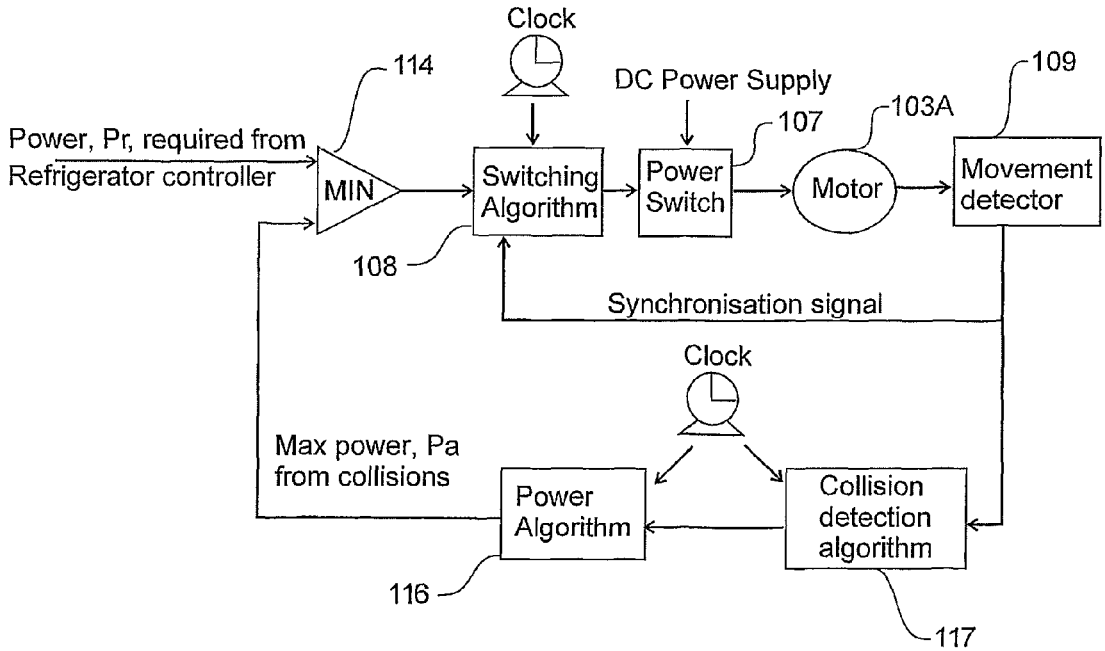
FIG. 5 shows the control system of FIG. 3 with a piston collision detection algorithm.
Figure 6:
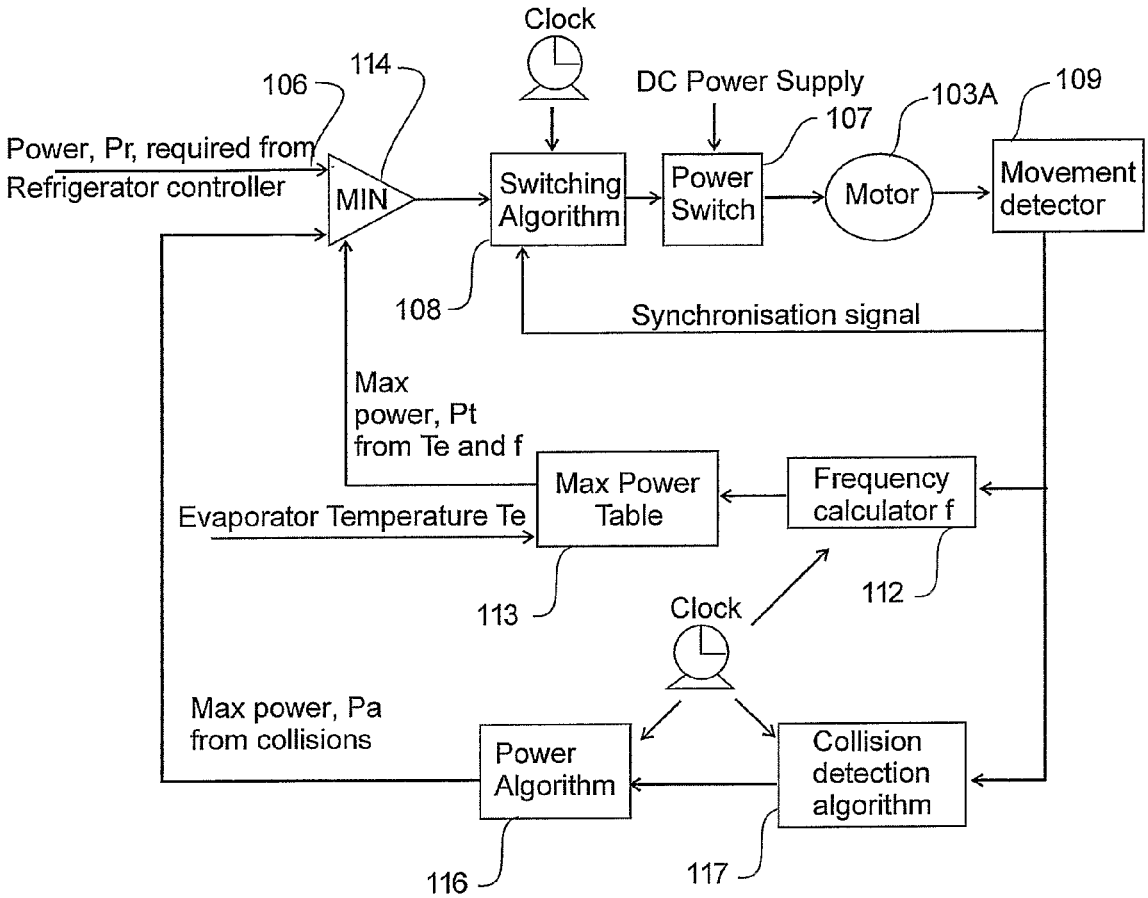
FIG. 6 shows the control system of FIG. 3 with the piston collision avoidance measures of FIG. 4 and the piston collision detection measures of FIG. 5.

The control system of the present invention may operate in conjunction with the basic motor control system of FIG. 3 and preferably, although not necessarily with the system of FIG. 4, the system of FIG. 5 or the system of FIG. 6.

Figure 7:
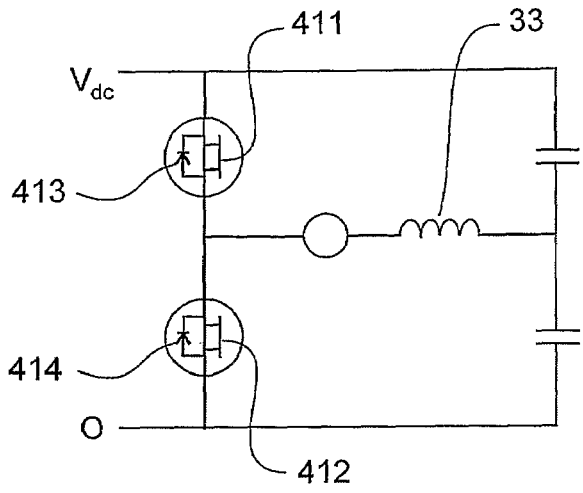
FIG. 7 shows an example of the power supply bridge driven by the compressor controller to energise the windings of the linear motor.

Referring to FIG. 3, the motor 103A of the linear compressor, which may be of the type already described with reference to FIG. 1, has its stator windings energised by an alternating voltage supplied from power switching circuit 107 which may take the form of the bridge circuit shown in FIG. 7. The bridge circuit 107 uses switching devices 411 and 412 to commutate current of reversing polarity through compressor stator winding 33. The other end of the stator winding is connected to the junction of two series connected capacitors which are also connected across the DC power supply.

The compressor controller is preferably implemented as a programmed microprocessor controlling the operation of the power switching circuit 107.

The switching circuit 107 is primarily controlled by a switching algorithm 108 executed by the control system microprocessor. The microprocessor is programmed to control the power input to be applied to the motor by the switching algorithm 108. The microprocessor may execute various functions or use tables, some of which, for the purposes of explanation, are represented as blocks in the block diagrams of FIGS. 3 to 6.

Reciprocations of the compressor piston and the frequency or period thereof are detected by movement detector 109 which in the preferred embodiment comprises the process of monitoring the back EMF induced in the compressor stator windings by the reciprocating compressor armature. This may in particular include detecting the zero crossings of that back EMF signal. Switching algorithm 108 which provides microprocessor output signals for controlling the power switch 107 has switching times initiated from logic transitions in the back EMF zero crossing signal 110. This ensures the windings are energised in synchronism with the instant natural frequency of the compressor, and the reciprocating compressor operates with good efficiency. The compressor input power may be varied by controlling either the current magnitude or current duration applied to the stator windings by power switch 107. Pulse width modulation of the power switch may also be employed.

FIG. 4 shows the basic compressor control system of FIG. 3 enhanced by the control technique disclosed in U.S. Pat. No. 6,809,434 which minimises piston/cylinder collisions in normal operation by setting a maximum power based on piston frequency and evaporator temperature. Output 111 from an evaporator temperature sensor is applied to one of the microprocessor inputs and piston frequency is determined by a frequency routine 112 which times the time between zero crossings in back EMF signal 110. Both the determined frequency and measured evaporator temperature are used to select a maximum power from a maximum power lookup table 113 which sets a maximum allowable power $P_t$ for a comparator routine 114. Comparator routine 114 receives, as a second input, value 106 representing the power demand required from the overall refrigerator control. The comparator routine 114 is used by switching algorithm 108 to control switching current magnitude or duration. Comparator routine 114 provides an output value P 115 which is the minimum of the $P_r$, power required by the refrigerator, and $P_t$, the power allowed from maximum power table 113.

Using just the control concepts explained with reference to FIG. 4 will result in the linear compressor 103A (when active) operating with no or minimal piston collisions in normal operation. However as disclosed in U.S. Pat. No. 6,812,597 linear compressor 103A may be run in a "maximum power mode" where higher power can be achieved than with the FIG. 4 control system, but with the inevitability of some piston collisions. A control system that facilitates this mode will now also be described.

Referring to FIG. 5 a power algorithm 116 is employed which provides values to another input to comparison routine 114. Power algorithm 116 slowly ramps up the compressor input power by providing successively increasing values to comparator routine 114 which causes switching algorithm 108 to ramp up the power switch current magnitude or duration. Power $P_a$ is increased by an incremental value every N cycles or piston reciprocations. This ramping continues until a piston collision is detected. Collision detection process 117 is preferably determined from an analysis of the back EMF induced in the compressor windings and the technique used may be either that disclosed in U.S. Pat. No. 6,812,597, which looks for sudden decreases in piston period, or that disclosed in U.S. patent application Ser. No. 10/880,389 which looks for discontinuities on the slope of the analogue back EMF signal.

Upon detection of a collision, power algorithm 116 causes decrements value $P_a$ to achieve a decrease of power. Power algorithm 116 then again slowly ramps up value $P_a$ until another collision is detected and the process is repeated.

Desirably, but not necessarily the high power control methodology described is used in conjunction with control for normal operation where collision avoidance is employed as described with reference to FIG. 4. A control system employing both techniques is shown in FIG. 6. Here the comparison routine 114 receives three inputs, $P_r$, $P_t$ and $P_a$.

Figure 8:
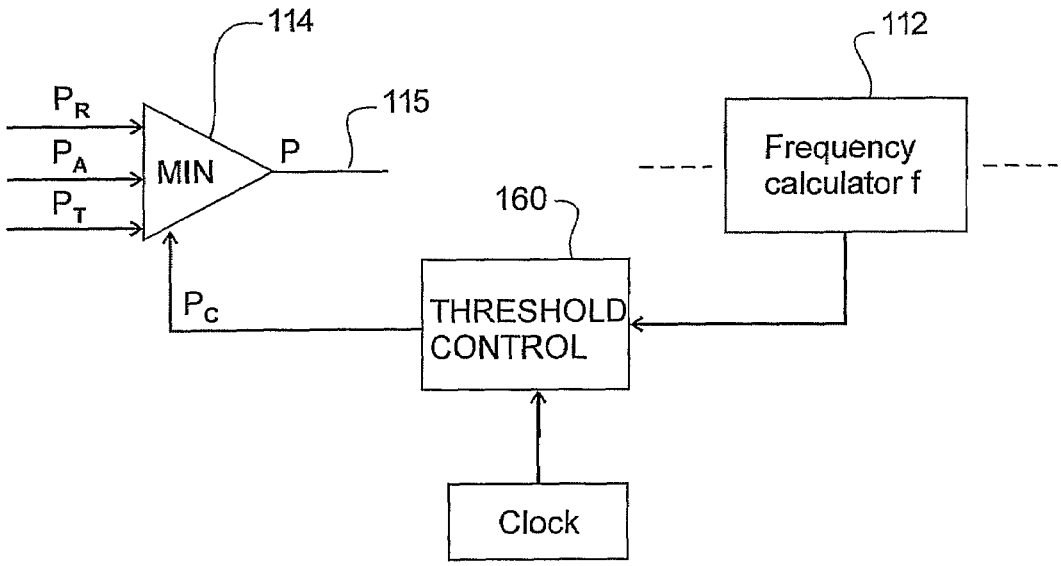
FIG. 8 shows the additional control system option according to the present invention, using running frequency thresholds.

According to the present invention the control system includes a further technique as illustrated in FIG. 8. This further technique may be applied in conjunction with anyone or more of the systems illustrated in FIGS. 3 to 6. According to this technique the compressor controller includes a gross control activated in accordance with the compressor running frequency.

This further control aspect is illustrated in FIG. 8, which provides another input value, $P_c$, to comparison routine 114. A frequency calculator 112 calculates the present operating frequency of the compressor in accordance with output of the movement detector routine 109. The frequency calculator routine 112 provides this running frequency for threshold control 160. Threshold control 160 compares the instant running frequency against a frequency threshold and provides value $P_c$ as output. The threshold control 160 may compare the instant running frequency against a lower frequency threshold, or against an upper frequency threshold.

Preferably the threshold control 160 compares the instant frequency at least against a lower frequency threshold. In this case the lower frequency threshold indicates a discharge pressure below a level that is suitable to support safe operation of the compressor. This is particularly the case where the compressor operates with gas bearings and a minimum discharge pressure is useful to maintain the effective operation of the gas bearings. The minimum threshold pressure is preferably predetermined for the compressor and stored in memory of the compressor controller.

The threshold control 160 may also compare the frequency against an upper threshold value. In this case the high frequency may indicate that the condenser temperature has become extremely elevated. This indicate abnormal operating conditions, such as exceptional refrigerator loading caused by refrigerator doors or compartments remaining open, or failure of one or more parts of the refrigeration system, such as failure of a condenser fan.

In each case of the lower threshold being met the threshold control preferably temporarily provides a value of $P_c$ which stops the compressor, for example setting $P_c$ as zero. However where the higher threshold is exceeded the value $P_c$ may be put out at a predetermined intermediate level that equates to moderate compressor output.

The threshold control may be programmed to continue to provide this reduced (or zero) power setting for a predetermined period of time and then to disable itself for a further predetermined period of time. While the threshold control is disabled the compressor will run according to the other power controlling algorithms. After this further predetermined time has elapsed the threshold control will once more be active.

The threshold control 160 may operate on the instantaneous running frequency, but may also require the threshold frequency to have been met for a predetermined period of time before providing the reduced (or zero) power value. So for example when the compressor is first activated the initial operating frequency will be low until pressure builds up in the high pressure side of the refrigeration circuit. By requiring the threshold to be met for a predetermined period of time before adjusting the power value $P_c$ the threshold control will not cut power to the compressor until sufficient time has elapsed for the refrigeration system to reach a steady state operating condition. Alternatively the threshold control may be effectively disabled for a predetermined period of time after the compressor is started.

In a case of the high threshold being exceeded the threshold control may also provide an additional output, for example to the refrigeration system controller 210. This output may alert the refrigeration system controller to an abnormal operating condition. The refrigeration controller 210 may respond to this alert by executing testing routines against one or more of the devices under its control, or by providing a user alert or fault report.

Figure 9:
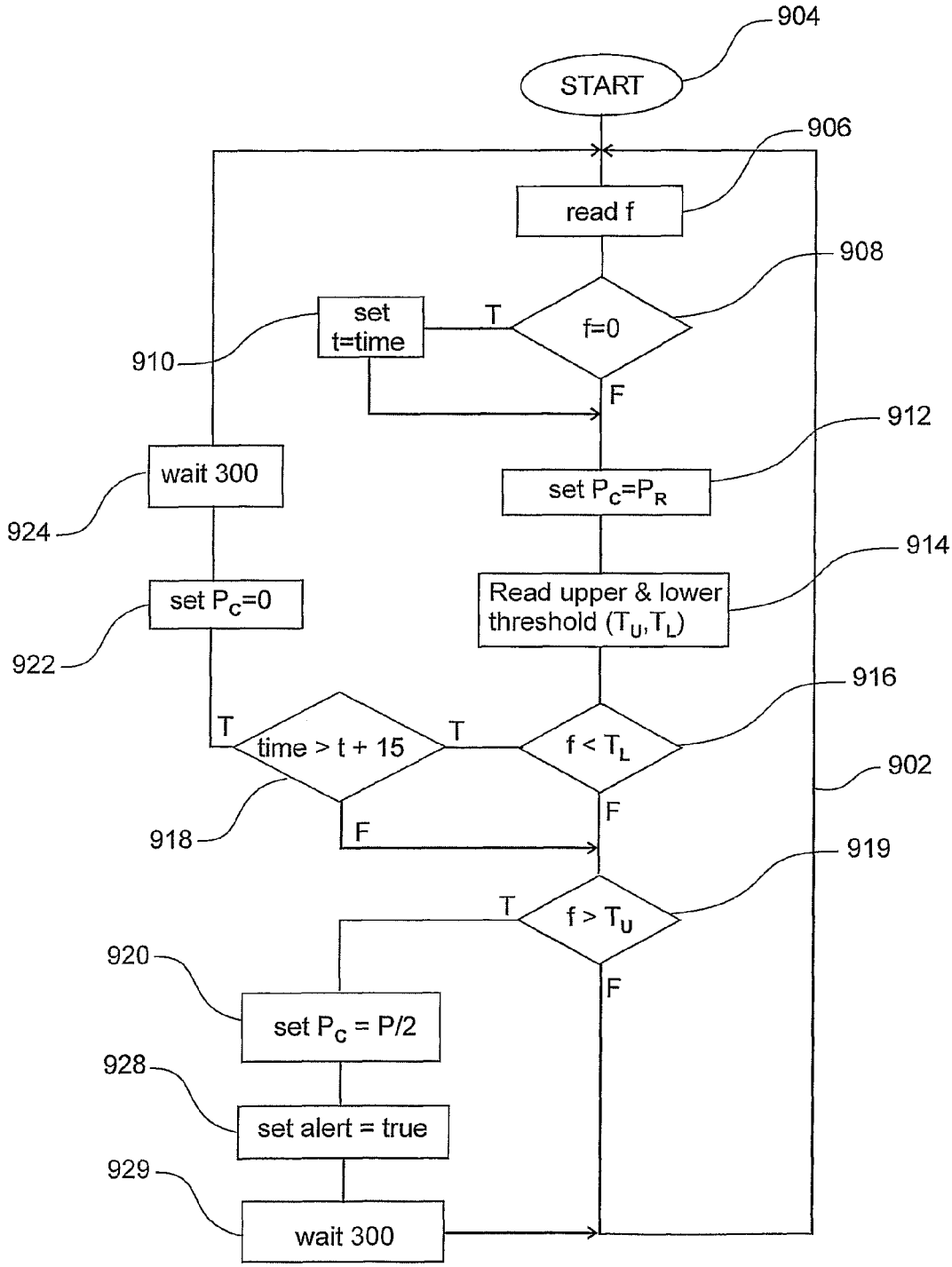
FIG. 9 is a flow diagram illustrating a standalone control program for implementing the control system option of FIG. 8.
Figure 10:
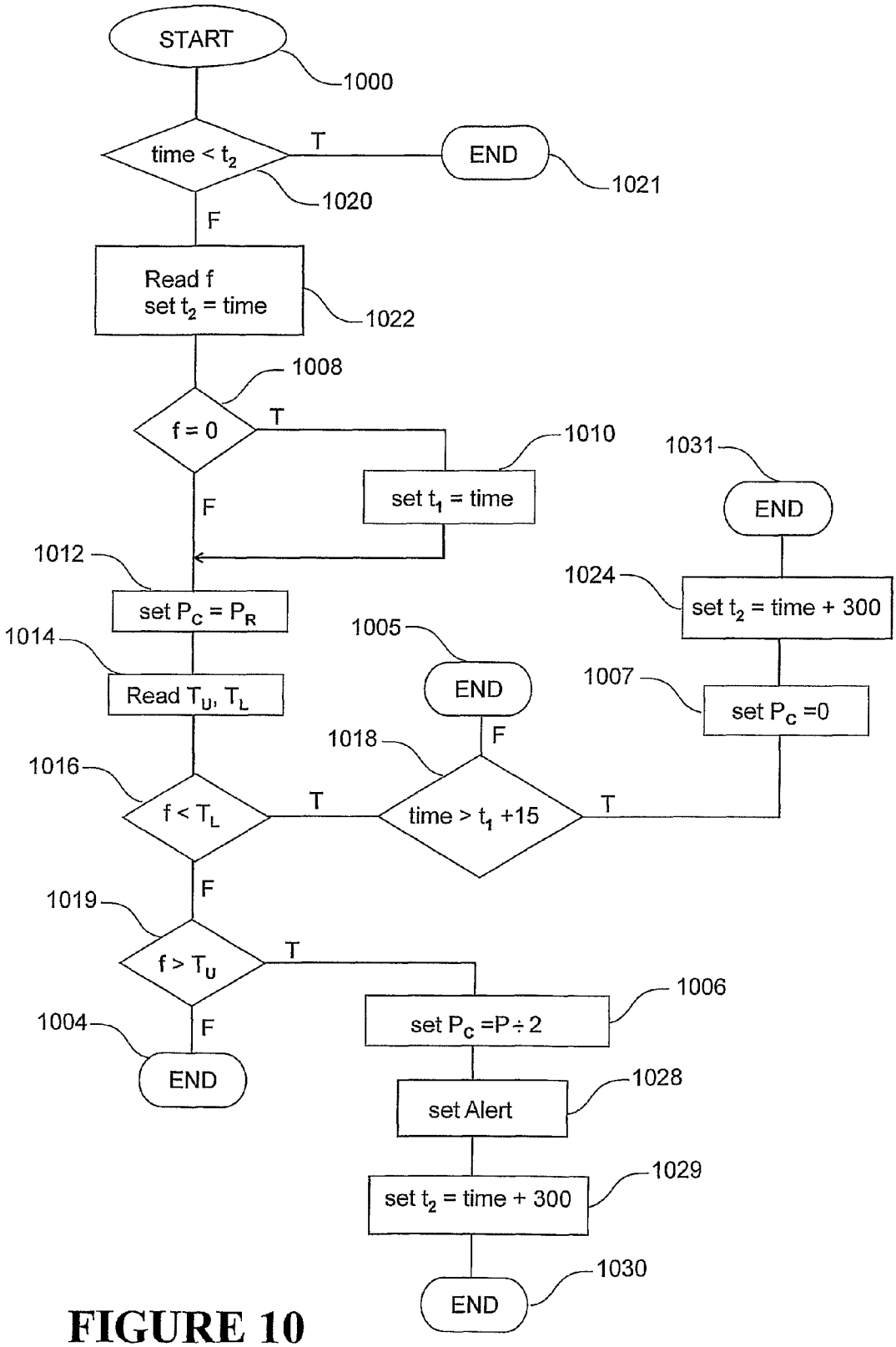
FIG. 10 is a flow diagram illustrating a subroutine control program for implementing the control system option of FIG. 8.

FIGS. 9 and 10 illustrate control program options for implementing the threshold control 160 of FIG. 8. The control program option of FIG. 9 implements a standalone control that might be run on a discrete microprocessor, or implemented as a discrete process running in parallel with other processes in a single microcomputer, or may be implemented in logic circuits. The process of FIG. 10 performs the same functions as the process of FIG. 9 but as a control subroutine for execution at intervals by a larger control process. For example the subroutine may be used in a complete control program that also implements the max power table 113, collision detection algorithm 117, power algorithm 116, frequency calculator 112 and comparator 114 of the system illustrated in FIG. 6. In either case components of the control system can be implemented in hardware or software or logic circuits at the desire of the system designer. Furthermore the functions may be partitioned between multiple discrete controller packages or integrated in a single controller package.

Referring now to FIG. 9 the standalone control includes a main control loop 902 that maintains output $P_c$ at the refrigerator demand power pr except in the case that the frequency falls below a predetermined threshold $T_L$ or above a predetermined threshold $T_U$.

The standalone control starts at step 904 at the time that the compressor commences operation. The control algorithm can start at the time that the controller is first powered up. The process proceeds to step 906 and reads the present running frequency f from frequency calculator 112. The control then proceeds to decision step 908.

If at step 908 the control determines that the frequency f is equal to zero, which indicates the compressor is not running, the process proceeds to step 910. If the process determines at step 908 that the frequency f does not equal zero, which indicates the compressor is running, the process proceeds to step 912.

If the compressor proceeds to step 910 the process sets a variable t as the present time. The process then proceeds to step 912.

At step 912 the process sets output value PC equal to refrigerator controller demand power $P_r$. This ensures that the process does not affect the output of comparator 114 unless the frequency f triggers a threshold control at later steps 916 or 919. The process then proceeds to step 914.

At step 914 the process reads upper and lower threshold values $T_U$ and $T_L$ respectively from a lookup table and then proceeds to step 916.

At decision step 916 the process determines whether the frequency f is less than the lower threshold value $T_L$. If true, the process proceeds to step 918. If false the process proceeds to step 919.

At decision step 919 the process determines whether the frequency f is greater than the upper threshold $T_u$. If true then the process proceeds to step 920. If false the process proceeds through loop 902 back to step 906.

If at step 916 the process determines that the frequency is less than the threshold value, the process proceeds to step 918 to determine whether the compressor has been running for at least 15 seconds. This ensures that the compressor is not running below the threshold frequency simply because the compressor is still in a starting phase of operation. The time for the frequency to build to a steady state above the lower threshold frequency will depend on the particular compressor and refrigeration system. The value 15 seconds is provided as an example only. So at step 918 the process determines whether the present time is greater than variable t plus 15 seconds. If true this indicates that the compressor is not in a starting phase so the control proceeds to step 922 to adjust the output value $P_c$. If false the compressor is assumed to be in a starting phase, for now, and the control proceeds to step 919. Step 919 will inevitably answer false and the control will proceed back through the loop 902 to step 906. The control will loop repeatedly until either the frequency reaches the lower threshold $T_L$ or the time is greater than t+15 seconds. The control will therefore either avoid shutting down the compressor during its starting condition or will subsequently catch an adverse running condition after only a short delay. Of course the selection of a delay time (in the example 15 seconds) is somewhat arbitrary and should depend on the compressor and the refrigeration system which is incorporated.

If the control process proceeds to step 922 from step 918, then at step 922 the process sets output $P_c$ as zero and proceeds to step 924. With output $P_c$ as zero this will inevitably be (or be equal to) the minimum value provided to comparator 114. Accordingly drive duty ratio P will be zero and power will be entirely removed from the compressor.

The standalone control proceeds to step 924 and waits before proceeding back into the start point of the loop. The waiting duration may be predetermined and stored within the control process, or may be determined from other running conditions, or from recent historical performance of the system. For example the wait period may be extended if the threshold control 160 is being repeatedly executed in short time. For example threshold control 160 may record a duration since the lower threshold was last triggered and where that duration is below a predetermined value the wait duration, which may be a variable with a preset value, may be incremented. Preferably a control step would periodically reset the duration variable. In the illustrated example the control process waits a predetermined period at step 924, such as 300 seconds. For a lower threshold frequency control this would seem about a minimum useful period. Five minutes should give the refrigerator operating conditions time to build up a small residual demand that will allow the compressor to run above the threshold frequency $T_L$ for at least a short period of time in its next cycle.

If the control process proceeds from step 919 to step 920 this indicates that the compressor is operating above the upper threshold $T_U$. In that case the threshold control sets the output value $P_c$ a reduced value, for example as a fraction of the present prevailing drive duty cycle value P. In the example $P_c$ is P/2. This will be half of the minimum value of the other inputs to comparator 114 ($P_r$ $P_a$ and $P_t$). The control then proceeds to step 928.

At step 928 the control process sets an alert variable as true. The refrigeration controller can use this to signal a fault or otherwise try and attempt to diagnose a fault in the system. The refrigeration controller may record the triggering of this alert in a data log for later analysis if the refrigerator develops a fault or is subject of a user service request. The control then proceeds to step 929.

At step 929 the process waits before proceeding back to step 906. The waiting duration at step 929 sets the duration for which the process will maintain output value $P_c$ at the reduced value. After this duration the value $P_c$ will be reset to value pr at step 912. The duration at step 929, like the duration at step 924 may be predetermined or may be adjusted by the control process to account for historical behaviour.

FIG. 10 illustrates an equivalent process operating as a control subroutine. To this extent loops that include a waiting time are eliminated. Furthermore instead of the process looping back to the start point of the process, each limb of the process terminates and returns the control to the process that called it. Accordingly the subroutine is for execution at short intervals rather than being a continuous standalone process. The variables referred to are persistent and remain set between iterations of the subroutine.

Each instance of operation of the process starts at step 1000. The subroutine proceeds to step 1020 to determine whether the time is less than a time variable $t_2$ which is carried forward from previous iterations of the process. Time variable $t_2$ will either have been set most recently at step 1022 or will have been incremented at steps 1024 or 1029 as will be described below. If the variable $t_2$ was set at step 1022 in the previous iteration of the control subroutine then the present time will be greater than $t_2$ and the subroutine will proceed to step 1022. Otherwise if the time was incremented at step 1024 or step 1029 less than 300 seconds previously then the present time will be less than $t_2$ and the subroutine will proceed from step 1020 to end at step 1021.

Where the routine proceeds to step 1022 the process reads in the present running frequency f from frequency calculator 112 and sets variable $t_2$ as the present time. The process then proceeds to decision step 1008.

At step 1008 the control determines whether the compressor is running, according to whether the frequency f equals zero. If true then the control proceeds to step 1010 and sets variable $t_1$ equal to the present time before proceeding to step 1012. If false the process proceeds directly to step 1012.

At step 1012 the process sets the present value of output $P_c$ equal to the demand duty cycle $P_r$. The process then proceeds to step 1014 to read in upper and lower threshold values $T_U$ and $T_L$ from a control table.

The process proceeds from step 1014 to step 1016 to determine whether the frequency is less than the lower threshold value $T_L$. If true the process proceeds to step 1018. Otherwise the process proceeds to step 1019.

At step 1019 the process determines whether the frequency is greater than the upper threshold $T_U$. If true the process proceeds to step 1006. Otherwise the process proceeds to end at step 1004. If the compressor is operating in a normal environmental range the process will usually proceed to end at step 1004 and the value $P_c$ will follow the value $P_r$.

Where the process proceeds to step 1018 from step 1016 this indicates that the compressor is running below the threshold frequency $T_L$. In that case at step 1018 the process determines whether the compressor is operating in a start up mode and has been running for less than a preset period. For example in the illustrated process if the present time is not greater than variable $t_1$+15 seconds then the process assumes that the compressor is in start up mode and proceeds to end at step 1005. Otherwise the process proceeds to step 1007 on the assumption that the compressor has been running now for at least 15 seconds at speeds above zero and therefore should have reached a stable operating condition. This start up duration may be varied according to the particulars of the refrigeration system in which the control is incorporated depending on the anticipated start up time to reach a stable running condition.

At step 1007 the control process sets output value $P_c$ as zero which will become the minimum power determined by comparator 114 and cause control output P to reduce to zero and the compressor will stop. The process then proceeds from step 1007 to step 1024 to set variable $t_2$ equal to the present time plus 300 seconds. This value will carry forward to subsequent iterations of the control subroutine and affect operation of the subroutine at step 1020. In effect this provides a delay of 300 seconds before the control subroutine will properly execute in a subsequent attempt. During this period the control process instead proceeds to end at step 1021. The duration 300 seconds indicated is illustrative. As with the embodiment of FIG. 9 a duration of delay may be predetermined or may be adapted according to recent history of running of the subroutine. The process then proceeds to end at step 1031.

If the compressor proceeded from step 1019 to step 1006, this indicates the compressor is running above the upper threshold $T_u$. In that case the control process at steps 1006 sets output value $P_c$ at a reduced level, for example as one half of the prevailing control value P so that $P_c$ will be half of the minimum value of control values $P_r$, $P_a$, $P_t$. Due to the operation of steps 1029 and 1020 this value of $P_c$ will endure for a delay period. At step 1028 the control subroutine will set an alert for the same purpose as the alert from the control of FIG. 9. Then proceeding to step 1029 the subroutine sets variable $t_2$ equal to the present time plus a delay period (for example 300 seconds). Again the delay period may be predetermined, or may be varied according to running conditions or recent history. The process then proceeds to end at step 1030.

It will be appreciated that the detailed processes of FIGS. 9 and 10 are particularly expressed in terms to integrate with the overall control structure and strategies of FIGS. 3 to 6 while these control strategies and processes are preferred and operate advantageously, the basic principles of controlling the compressor according to the detected resonant frequency, by removing power from the compressor when a frequency falls below a lower threshold level, or reducing power to the compressor when the frequency rises above an upper threshold level, or both, are applicable in a wide variety of control systems and programs.

Accordingly the invention consists in a controller receiving feedback concerning the operation of the compressor and providing a drive signal for applying current to the linear motor in harmony with the instant natural frequency of the compressor. The compressor includes means for removing power from the compressor when the natural frequency of the compressor falls below a floor threshold, or which reduces power to the compressor when the natural frequency rises above a floor threshold, or both. These means may comprise a threshold control algorithm implemented in software or hardware.

The controller may include means for obtaining an indicative measure of the reciprocation period of the piston, and the means for removing power may include a comparator comparing the indicative measure against the threshold.

The indicative measure of the reciprocation period may be a measure of a single reciprocation period, an average of a series or sub-series of a recent sequence of reciprocation periods, or a present estimate of the running frequency of the compressor.

Feedback to the controller may include back EMF data and the means for obtaining an indicative measure of the reciprocation period of the piston may obtain the measure from analysis of the back EMF data.

The floor threshold, the ceiling threshold, or both, may be a predetermined threshold read from a memory, or may be a threshold at least partially determined or modified by calculation according to present conditions.

The compressor may lack oil lubrication. Sliding of the piston in the cylinder may be facilitated by gas bearings.

Where sliding of the piston in the cylinder is facilitated by static gas bearings, a compressed gases supply path may extend from a reservoir that in use contains gases compressed by the compressor to the static gas bearings.

The controller may receive a demand input and in normal operation apply an amount of current to the linear motor dependant on the demand input. The demand input may be a demand level input or a demand change input.

The controller may override the normal operation in the case of the natural frequency of the compressor rises above a ceiling threshold, or falling below a floor threshold, or both, and also in the case of detecting a collision of the piston with a head or valve plate of the compressor.

The controller may detect a collision on the basis of analysis of back EMF data from the linear motor.

The invention claimed is:

1. A method of controlling a free-piston linear compressor comprising the steps of:

energizing said compressor according to a demand load so that said compressor reciprocates at its natural frequency according to the system operating conditions, monitoring the frequency of reciprocation of said compressor, and ceasing to energise said compressor when the frequency of reciprocation is below a floor threshold.

2. A method as claimed in claim 1 wherein said method includes, at each time of starting said compressor, allowing said compressor time to achieve a steady state running condition before ceasing to energise said compressor when the frequency of reciprocation is below a floor threshold.

3. A method as claimed in claim 1 wherein the step of monitoring the frequency of reciprocation of said compressor includes monitoring the reciprocation period of an electronically commutated linear motor driving said compressor.

4. A method as claimed in claim 1 wherein the step of ceasing to energise said compressor when the frequency of reciprocation is below a floor threshold includes determining a floor threshold frequency, comparing the present frequency of reciprocation against said determined floor threshold, and ceasing to energise said compressor when said present frequency is below said floor threshold.

5. A method as claimed in claim 1 wherein said method includes, after ceasing to energise the compressor due to the running frequency dropping below said floor threshold, the steps of: recommencing energisation of said compressor after a delay period, wherein said delay period is at least 300 seconds.

6. A method as claimed in claim 1 wherein the step of monitoring the frequency of reciprocation of said compressor includes monitoring back EMF voltages of an electronically commutated linear motor driving said compressor.

7. A method as claimed in claim 6 wherein the electronically commutated linear motor driving the compressor is supplied from a power supply circuit including at least one power supply switch for applying current to a winding of said linear motor, said linear motor is energized so that the power supply switch is off at the ends of stroke of the compressor, and monitoring back EMF voltages of an electronically commutated linear motor driving said compressor includes determining a period between back EMF zero crossings.

8. A method as claimed in claim 1 including the step of reducing the power applied to said compressor when the frequency of reciprocation is above a ceiling threshold.

9. A method as claimed in claim 8 wherein the step of reducing the power applied to the compressor when the frequency of reciprocation is above a ceiling threshold includes determining a ceiling threshold frequency, comparing the present frequency of reciprocation against said determined threshold, and reducing power to said compressor when said present frequency is above said threshold.

10. A method as claimed in claim 9 wherein said method includes, after reducing power applied to the compressor due to the running frequency rising above a ceiling threshold, the steps of: recommencing energisation of said compressor according to said demand load after a delay period, wherein said delay period is at least 300 seconds.

11. A method of controlling a free-piston linear compressor comprising the steps of:

energizing said compressor according to a demand load so that said compressor reciprocates at its natural frequency according to the system operating conditions, monitoring the frequency of reciprocation of said compressor, and reducing the power applied to said compressor when the frequency of reciprocation is above a ceiling threshold.

12. A free piston gas compressor comprising:

a cylinder, a piston, the piston reciprocable within the cylinder, a reciprocating linear electric motor coupled to the piston and having at least one excitation winding, a controller receiving feedback concerning the operation of the compressor, providing a drive signal for applying current to the linear motor in harmony with the instant natural frequency of the compressor, the controller including means for removing power from the compressor when the natural frequency of the compressor falls below a floor threshold.

13. A free piston gas compressor as claimed in claim 12 wherein the controller includes a computer and said means for removing power from the compressor when the natural frequency of the compressor falls below a floor threshold comprises a program stored for execution by said computer, said program when run causing said computer to:

determine a floor threshold, monitor the present running frequency of the compressor, compare the present running frequency against said floor threshold, and cause power to be removed from said linear electric motor when said comparison indicates that the present running frequency is below said floor threshold.

14. A free piston gas compressor as claimed in claim 13 wherein said program when run causes said computer to monitor the present running frequency by obtaining an indicative measure of the reciprocation period of the piston.

15. A free piston gas compressor as claimed in claim 13 wherein the drive signal from the controller includes a PWM signal having a duty cycle determined by an output of said computer, and said program when run causes said computer to remove power from said linear electric motor by adjusting said duty cycle to zero.

16. A compressor as claimed in claim 12 wherein said compressor lacks oil lubrication, and sliding of the piston in the cylinder is facilitated by gas bearings.

17. A compressor as claimed in claim 16 wherein said sliding of the piston in the cylinder is facilitated by static gas bearings, with a compressed gases supply path extending to said static gas bearings from a reservoir that in use contains gases compressed by the compressor.

18. A compressor as claimed in claim 12 wherein said controller receives a demand input and in normal operation applies an amount of current to the linear motor dependant on the demand input.

19. A compressor as claimed in claim 18 wherein said controller overrides the normal operation in the case of said natural frequency of the compressor rises above a ceiling threshold, or falling below a floor threshold, or both, and in the case of detecting a collision of the piston with a head or valve plate of the compressor.

20. A compressor as claimed in claim 19 wherein said controller detects a collision on the basis of analysis of the back EMF data.

21. A free piston gas compressor comprising:

a cylinder, a piston, the piston reciprocable within the cylinder, a reciprocating linear electric motor coupled to the piston and having at least one excitation winding, a controller receiving feedback concerning the operation of the compressor, providing a drive signal for applying current to the linear motor in harmony with the instant natural frequency of the compressor, the controller including means for reducing power to the compressor when the natural frequency of the compressor rises above a ceiling threshold.

* * * * *